United States Patent [19]

Piper

[11] Patent Number: 4,460,803

[45] Date of Patent: Jul. 17, 1984

[54] UNITARY WOVEN JACKET AND ELECTRICAL TRANSMISSION CABLE AND METHOD OF MAKING SAME

[75] Inventor: Douglas E. Piper, Greenville, S.C.

[73] Assignee: Woven Electronics Corporation, Mauldin, S.C.

[21] Appl. No.: 466,564

[22] Filed: Feb. 15, 1983

[51] Int. Cl.[3] ..... H01B 11/06; D03D 15/02

[52] U.S. Cl. ..... 174/36; 139/425 R; 174/117 M

[58] Field of Search ..... 174/36, 117 M; 139/425 R

[56] References Cited

U.S. PATENT DOCUMENTS 3,582,537 6/1971 Perreault ..... 174/117 M
3,909,508 9/1975 Ross ..... 174/117 M
4,095,042 6/1978 Ross ..... 174/36
4,143,236 3/1979 Ross et al. ..... 174/117 M X
4,281,211 7/1981 Tatum et al. ..... 174/36

*Primary Examiner*—J. V. Truhe
*Assistant Examiner*—Morris H. Nimmo
*Attorney, Agent, or Firm*—Dority & Flint

[57] ABSTRACT

A woven jacket (A) and woven transmission cable (B) are woven together as one-piece. A common weft element (18) is interwoven between the cover (A) and cable (B) which are woven simultaneously on a loom. Weft pick (18*a*) is woven in the cover exclusive of the cable while weft pick (18*b*) is broken out of the cover and woven in the cable to physically attach these together.

19 Claims, 7 Drawing Figures

UNITARY WOVEN JACKET AND ELECTRICAL TRANSMISSION CABLE AND METHOD OF MAKING SAME

BACKGROUND OF THE INVENTION

The invention relates to flexible woven high frequency transmission cables of the type which are generally flat and include a plurality of conductors extending in the warp direction of the cable which transmit high frequency signals such as utilized in communication and computer systems. In routing the cables through the chassis of the computer or other installation, it is often necessary to flex and distort the cable in reaching to a specific location. The cable also encounters considerable wear and abrasion in use. This wear and abrasion, as well as the distortion of the cable conductors in routing the cable, often cause changes in the cable characteristics which influence the accuracy of the signal being transmitted and the life of the cable.

It has been proposed in various applications to cover the transmission cable by means of either a vinyl or woven jacket such as disclosed in U.S. Pat. Nos. 3,254,678 and 4,281,211. However, slippage occurs between the cover and the cable during routing and use of the cable due to the separated construction of each resulting in causing wear and abrasion. In many applications, the cable undergoes repeated flexing further increasing relative movements between the jacket and cable.

Accordingly, an important object of the present invention is to provide a flexible woven high frequency transmission cable which is highly flexible yet is protected from abrasion and other forces tending to impair the characteristics and life of the cable.

Another important object of the present invention is to provide a flexible one-piece woven electrical transmission cable and jacket wherein the jacket protects both the physical and electrical characteristics of the cable.

Yet another important object of the present invention is to provide a jacketed high frequency woven transmission cable which is highly flexible and is protected from abrasion and wear by a one-piece construction which virtually eliminates slippage between the outer jacket and inner cable.

Still another important object of the present invention is to provide a woven high frequency transmission cable having an outer woven cover and an inner woven cable wherein a common weft yarn is interwoven with the outer cover and inner cable to physically attach the cover and cable as one-piece.

SUMMARY OF THE INVENTION

The above objectives are accomplished according to the present invention by providing an outer woven cover and an inner electrical transmission cable wherein a common weft yarn is woven between the cover and cable at alternating picks such that the cover and cable are joined physically as one-piece. In the method, the common weft yarn is broken out of the woven cover and woven with the woven cable at every fifth pick whereby the cover fabric is more closed than the cable fabric for protection. A relatively stiff warp element is woven in the outermost edges of the cable to prevent pulling in of the cable edges during weaving.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
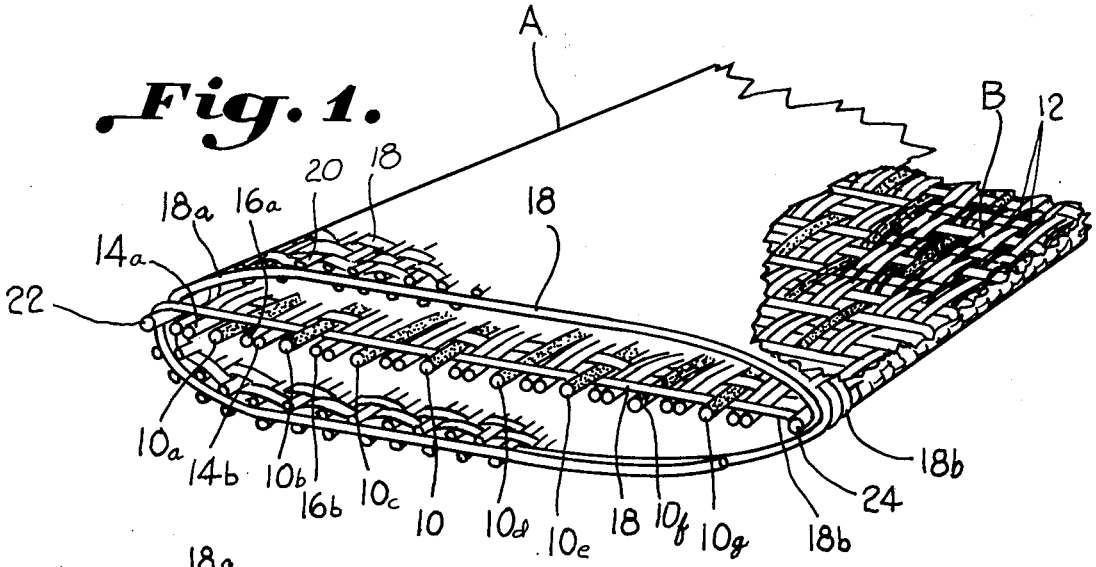
FIG. 1 is a partial perspective view illustrating a unitary jacketed woven transmission cable constructed according to the present invention with part of the outer jacket broken away to illustrate the inner woven cable.

Referring now in more detail to the drawings, a one-piece woven jacketed electrical transmission cable is illustrated which includes an outer woven cover A and an inner woven high frequency electrical transmission cable B. While any construction may be had for the woven transmission cable, the unitary construction of an outer cover A and woven cable B is particularly advantageous for a controlled impedance high frequency transmission cable such as illustrated in U.S. Pat. No. 4,143,236.

This type of cable is particularly accurate in transmitting signals between the input and the output of the cable. The woven construction of the cable fixes the center-to-center spacing of the signal wires and associated ground wires to control and maintain the impedance characteristic of the cable for accurate transmission of signals. It is particularly advantageous in such a cable to protect against abrasion and wear during routing and use of the cable to maintain its impedance characteristic and accuracy. Accordingly, the drawings illustrate a woven transmission cable B constructed in accordance with U.S. Pat. No. 4,143,236 which is hereby incorporated herein.

Transmission cable B includes a plurality of warp elements extending in a warp direction which include a number of warp conductor elements and warp yarns 12. The warp conductors include signal conductors 10 and ground conductors 14 and 16. Signal conductors 10 are arranged in a substantially side-by-side relationship for transmitting high frequency electrical transmission signals. Specifically, ten signal conductors are illustrated at 10*a* through 10*g*.

Longitudinally extending ground wires 14 and 16 are carried on each side of the signal wires 10. For example, a ground wire 14*b* is carried on one side of signal wire 10*b* and a ground wire 16*b* is carried on the opposing side of the signal wire along the length of the cable. The configuration of the ground and signal wires in the weave pattern of the woven cable may be had in any configuration such as that illustrated in U.S. Pat. No. 4,143,236.

The cable warp yarns 12 are woven with a cable weft yarn element 18. The cable weft yarn is interwoven with the warp yarns 12 as well as the conductors 10 which extend in the warp direction and thus form warp elements. This provides an integral woven cable fabric. The cable may also be constructed in a twill weave pattern wherein the conductor elements 10 are the only warp elements in the cable and are woven with cable weft element 18.

Woven cover A includes a cover weft yarn element which in the illustrated embodiments consists of the same weft element 18 of the woven cable. Cover weft yarn 18*a* is woven with a plurality of warp yarns 20 to define a woven cover fabric.

Outer cover A and inner cable B are woven simultaneously on a loom. Having been taught the construction and method for a one-piece woven jacket and transmission cable according to the invention, one skilled in weaving would readily be able to program the weaving and making of such a cable on a loom.

In a preferred embodiment, FIGS. 2 through 7, weft yarn 18 is woven in cover A exclusive of cable B for a number of picks. The weft yarn is then broken out of the cover and woven through the cable B for a number of picks. The common weft yarn is then broken out and returned to the weaving of outer cover A. The cover A and cable B are thus interwoven with each other and physically attached as one-piece.

In the method of the invention, the common weft yarn 18 is woven in alternate picks with the woven cover A and cable B. As illustrated, the weft yarn 18 is woven every fifth pick with outermost warp elements 22 and 24 of the woven cable fabric. As illustrated, these warp elements are conductors which are grounded and not warp yarns. It has been found that warp elements 22 and 24 need be relatively stiff wires compared to the remaining conductor wires 10, 14, 16 to maintain the cable configuration during and after weaving. Owing to weaving of cover A in tubular form, weft 18 tends to pull in the sides of cable B altering the spacing of adjacent conductors thus affecting the cable characteristics. Preferably, wires 22 and 24 are 28 gauge where the remaining conductors are 34 gauge. The heavier gauge wire is sufficient to resist pulling in of the cable sides by weft 18.

Figure 2:
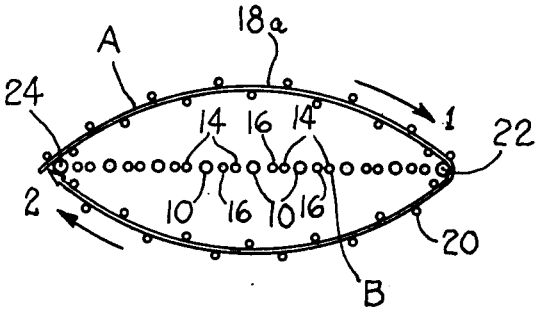
FIG. 2 is a schematic view illustrating a unitary woven jacketed cable and method therefor according to the present invention wherein a common weft yarn is woven in first and second picks through a woven cover surrounding an electrical transmision cable.
Figure 3:
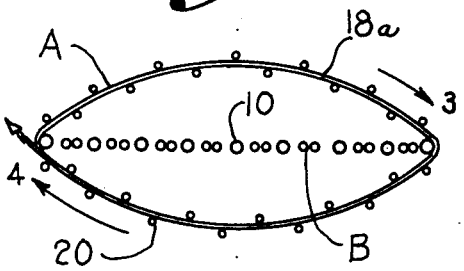
FIG. 3 is a schematic view illustrating a unitary woven jacketed cable and method therefor according to the present invention wherein a common weft yarn is woven through an outer woven cover in a third and fourth pick simultaneous with the weaving of an inner woven transmission cable according to the invention.

In FIG. 2, the common weft yarn 18 passes over and under the woven cable B while it is woven in the woven cover fabric as 18*a* together with the warp yarns 20. In FIG. 3, the common weft yarn 18 again passes under and over the outside of woven cable B while being woven in cover A.

Figure 4:
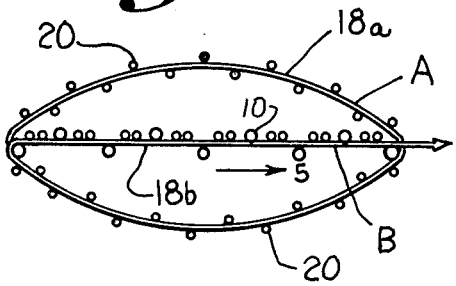
FIG. 4 is a schematic view illustrating a unitary woven jacketed cable and method therefor according to the present invention wherein a common weft yarn is woven through a woven transmission cable in a fifth pick according to the invention.

In FIG. 4, the common weft yarn 18 leaves the woven cover fabric of the outer cover A and is woven about the outermost edge warp element 22 of woven cable B and is woven as 18*b* with the warp yarns 12 and warp element 10, 14, 16 of the woven cable fabric. The weft 18 is excluded from cover A during this pick as 18*b*.

Figure 5:
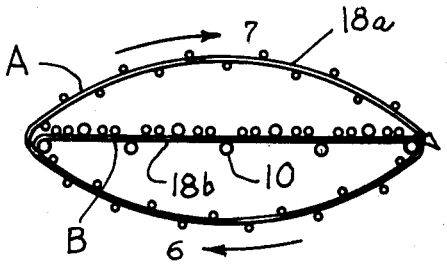
FIG. 5 is a schematic view illustrating a unitary woven jacketed cable and method therefor according to the present invention wherein a common weft yarn is broken out of a weave of a woven electrical transmission cable and is woven through an outer cover in a sixth and seventh pick according to the invention.

In FIG. 5, the weft yarn 18 is woven about the outermost warp element 22 of the woven cable fabric where it leaves the woven cable fabric and is again woven in the woven cover fabric of the outer woven cover A as pick 18*a*.

Figure 6:
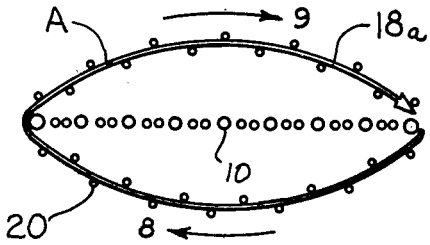
FIG. 6 is a schematic view illustrating a unitary woven jacketed cable and method therefor according to the present invention wherein a common weft yarn is woven in an outer cover surrounding a transmission cable on an eighth and ninth pick according to the invention.
Figure 7:
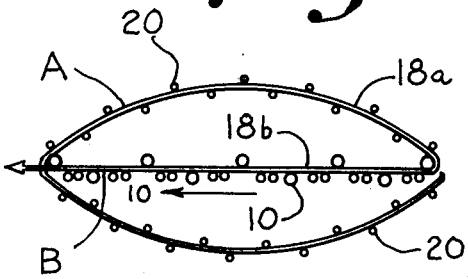
FIG. 7 is a schematic view illustrating a unitary woven jacketed cable and method therefor according to the present invention wherein a common weft yarn from an outer cover is woven through an inner woven electrical transmission cable structure according to the invention on a tenth pick of the weft yarn.

In FIGS. 6 and 7, the weft yarn 18 once again passes over and under the outside of woven cable B for two picks while weaving in the cover A. Thereafter, it is woven in the reverse direction about the outermost cable warp element 24 and through the woven cable B as 18*b* where it repeats the weaving cycle beginning in FIG. 2.

In one embodiment of the invention, the cover warp yarns 20 consist of metallicized yarns which includes a metallic yarn or metallic coated yarn such as silver or nickel plated nylon. In this manner, not only are the cables' physical characteristics protected, but the electrical characteristics are protected by a metal shield provided by the metallic yarns woven in a plain weave in cover A. The weft yarn 18 remains a regular nonmetallic yarn and is common to both the cable and cover.

Thus, it can be seen that an advantageous woven construction can be had for a flexible high frequency transmission cable and outer jacket can be had wherein the jacket and cable are physically attached and constructed as one piece to avoid slippage therebetween. The fabric of cover A includes twice as many picks of the weft yarn as the cable fabric B providing a tighter more closed fabric for cable protection. Preferably, cable B includes 16 picks per inch and cover A 32 picks per inch.

While the invention is illustrated as using a single weft system, separate weft systems may be used for the cover and cable with interweaving between the cover and cable being made to effect physical attachment. In this case, a cross-shot shuttle loom may be employed.

The unitary woven electrical transmission cable and jacket have been described and illustrated as woven on a shuttle loom. It is to be understood that the same may also be woven on a narrow fabric needle loom which is much faster. In this case, one of the edges of the unitary construction will include a catch cord which catches and is knitted with the weft element along the length of the woven construction on the one side and each pick will include the weft yarn doubled on itself as is conventional with needle loom construction.

While a preferred embodiment of the invention has been described using specific terms, such description is for illustrative purposes only, and it is to be understood that changes and variations may be made without departing from the spirit or scope of the following claims.

What is claimed is:

1. A jacketed unitary woven electrical transmission cable which includes an outer woven cover having outer woven cover fabric and an inner woven electrical transmission cable having woven transmission cable fabric, said unitary woven electrical transmission cable comprising:

a plurality of transmission cable warp elements which includes a number of elongated electrical conductors extending in a warp direction in said woven electrical transmission cable;

a transmission cable weft yarn woven with said transmission cable warp elements to define said woven transmission cable fabric;

said outer woven cover woven about said woven electrical transmission cable;

said outer woven cover including a cover weft yarn woven with a plurality of cover warp yarns to define said outer woven cover fabric; and said cover weft yarn being woven with a portion of said transmission cable warp elements in said woven electrical transmission cable fabric along the length of said cable so that said woven transmission cable fabric and said outer woven cover fabric are physically attached in a one-piece woven construction.

2. The cable of claim 1 wherein said cover weft yarn and said transmission cable weft yarn consist of a single common yarn.

3. The cable of claim 1 including a stiffening warp member woven in said transmission cable fabric at outermost edges thereof having a heavier gauge than the remaining of said transmission cable warp elements and around which said cover weft yarn passes in said construction opposing the tendency of said weft yarn to pull in the sides of said cable.

4. The cable of claim 1 wherein said cover weft yarn is woven with said portion of said cable warp elements at least every fifth pick of said weft yarn.

5. The cable of claim 1 wherein said portion of said transmission cable warp elements include the outermost warp elements in said electrical transmission cable.

6. The cable of claim 1 wherein said transmission cable warp elements include a plurality of warp yarns woven with said number of warp conductors and said transmission cable weft yarn.

7. A method of constructing a unitary jacketed woven electrical transmission cable of the type which includes a woven outer cover and an inner woven electrical transmission cable having a plurality of warp elements including a number of elongated electrical conductors extending in a warp direction of the cable comprising:

weaving said transmission cable warp elements and a first weft yarn together to form said inner woven electrical transmission cable;

simultaneously weaving a plurality of cover warp yarns and a second weft yarn to form said outer woven cover about said inner woven transmission cable while said transmission cable is being woven; and interweaving one of said weft yarns with one of said warp elements so that said inner woven electrical transmission cable and said outer woven cover are simultaneously woven and attached together as one-piece.

8. The method of claim 7 including said transmission cable warp elements a heavier stiffening warp member in the outermost edges of said woven transmission cable which is heavier than the remaining warp elements and over which said cover weft yarn passes in said woven construction.

9. The method of claim 7 including weaving a common weft yarn as said first and second weft yarns in said one-piece construction.

10. The method of claim 9 wherein said common weft yarn is woven with said cable warp yarn on every fifth pick of said weft yarn.

11. A method of weaving a one-piece jacketed woven electrical transmission cable having an outer woven cover and an inner woven cable having a plurality of conductors extending in a warp direction comprising:

weaving a common weft element with a plurality of cover warp elements to define outer woven cover fabric;

weaving said common weft element with a number of transmission cable warp elements to define woven cable fabric; and weaving said common weft element with selected ones of said cable warp elements at alternate picks of said weft element along the length of said woven cable exclusive of said woven cover fabric;

whereby a one-piece jacket construction is had preventing slippage between said outer woven cover and said inner woven cable to reduce abrasion.

12. The method of claim 11 including weaving a stiffening warp member adjacent outermost edges of said woven cable about which said common weft element passes prior to weaving through said woven cable fabric.

13. The method of claim 11 including weaving a number of warp yarns as a part of said cable warp elements with the remaining of said cable warp elements being said conductors.

14. A method of constructing a flexible woven electrical transmission cable and outer cover surrounding and jacketing said cable so that slippage between the cable and outer cover is avoided and wear and abrasion of the cable is reduced, said woven cable being of the type having a number of cable warp elements which are electrical conductors extending longitudinally in a warp direction of said cable, said method comprising:

weaving a transmission cable weft element with said cable warp elements to define a woven electrical transmission cable;

weaving an outer cover simultaneously with weaving said woven transmission cable about the outside of said woven transmission cable by weaving a plurality of cover warp elements with a cover weft element;

interweaving at least one of said weft or warp elements of said woven cover with at least one of said weft or warp elements of said woven electrical transmission cable to physically attach said woven cover and woven electrical transmission cable together as one-piece thereby reducing relative movement therebetween.

15. The method of claim 14 comprising the step of including in said portion of said cable warp elements a number of warp yarns.

16. The method of claim 14 including physically attaching said woven cable and woven cover by weaving a common weft yarn through said woven cover and woven cable whereby said cover and cable weft element consist of a single weft element.

17. The method of clalim 14 including the step of providing metallicized yarns in said cover warp elements to provide a woven metal shield about said inner woven cable.

18. The method of claim 11 including the step of providing metallicized yarns in said cover warp elements to provide a woven metal shield about said inner woven cable.

19. The cable of claim 1 wherein said cover warp yarns consist of metallicized yarns providing a woven metal shield about said inner woven cable.

* * * * *